US009032696B2

(12) United States Patent
Schilling

(10) Patent No.: US 9,032,696 B2
(45) Date of Patent: May 19, 2015

(54) METHOD OF SHRINKING A HEAT SHRINKABLE FILM ONTO PRODUCT UNITS

(75) Inventor: Christian Schilling, Diemelsee (DE)

(73) Assignee: KHS GmbH, Dortmund (DE)

( * ) Notice: Subject to any disclaimer, the term of this patent is extended or adjusted under 35 U.S.C. 154(b) by 695 days.

(21) Appl. No.: 12/363,865

(22) Filed: Feb. 2, 2009

(65) Prior Publication Data

US 2010/0031608 A1 Feb. 11, 2010

Related U.S. Application Data

(63) Continuation-in-part of application No. PCT/EP2007/006750, filed on Jul. 31, 2007.

(30) Foreign Application Priority Data

Aug. 4, 2006 (DE) ..... 10 2006 036 590

(51) Int. Cl.
*B65B 53/06* (2006.01)

(52) U.S. Cl.
CPC ..... *B65B 53/06* (2013.01); *B65B 53/063* (2013.01); *B65B 53/066* (2013.01)

(58) Field of Classification Search
CPC ..... B65B 53/066; B65B 53/063; B65B 53/06
USPC ..... 53/441, 442, 463, 557, 48.2, 48.6; 432/121, 135
See application file for complete search history.

(56) References Cited

U.S. PATENT DOCUMENTS 3,397,465 A * 8/1968 Carmichael ..... 34/225
3,668,817 A * 6/1972 Bell ..... 53/397
3,897,671 A * 8/1975 Higgins ..... 53/442
4,059,400 A * 11/1977 Heckman et al. ..... 432/124
4,228,345 A 10/1980 Stricker et al.
4,263,725 A * 4/1981 Ganz ..... 34/231

(Continued)

FOREIGN PATENT DOCUMENTS

DE 24 40 517 3/1975
DE 3615532 A1 * 11/1987 ..... B65B 53/02

(Continued)

OTHER PUBLICATIONS

International Search Report PCT/EP2007/006750 and English translation thereof.

(Continued)

*Primary Examiner* — Stephen F Gerrity
(74) *Attorney, Agent, or Firm* — Nils H. Ljungman & Associates

(57) ABSTRACT

A method of shrinking a heat shrinkable film onto product units, in which a heat shrinkable film is wrapped around a product unit so as to form an opening in the heat shrinkable film on a side of the product unit. A hot, gaseous medium is then emitted from at least one discharge or nozzle to thereby shrink the heat shrinkable film on the product unit while simultaneously moving the product unit on a conveying arrangement along a transport path. The emission of the hot, gaseous medium is controlled such that essentially all of the hot, gaseous medium emitted from the at least one discharge to shrink the heat shrinkable film on the product unit, during movement of the product unit along the transport path, is directed at the side of the product unit having the opening in the heat shrinkable film.

20 Claims, 10 Drawing Sheets

(56) References Cited

U.S. PATENT DOCUMENTS

| | | | | | |
|---|---|---|---|---|---|
| 4,579,614 | A * | 4/1986 | Burmeister et al. | ..... | 156/85 |
| 4,979,314 | A * | 12/1990 | Fresnel | ..... | 34/437 |
| 5,787,682 | A | 8/1998 | Tolson | | |
| 6,648,634 | B2 * | 11/2003 | Nava | ..... | 432/121 |
| 6,689,180 | B1 * | 2/2004 | Liao | ..... | 53/557 |
| 7,363,728 | B1 * | 4/2008 | McNeil et al. | ..... | 34/381 |

FOREIGN PATENT DOCUMENTS

| | | | | | |
|---|---|---|---|---|---|
| DE | 19803244 | C2 * | 4/2003 | ..... | B65B 53/06 |
| DE | 10 2005 05929 | | 6/2006 | | |
| EP | 1 683 723 | | 7/2006 | | |
| FR | 2859704 | A1 * | 3/2005 | ..... | B65B 53/063 |
| GB | 970404 | A * | 9/1964 | ..... | B65B 53/063 |
| GB | 970406 | A * | 9/1964 | ..... | B65B 53/063 |
| GB | 1062349 | A * | 3/1967 | ..... | B65B 53/063 |
| GB | 1075614 | A * | 7/1967 | ..... | B65B 53/06 |
| GB | 2224712 | A * | 5/1990 | ..... | B65B 53/063 |
| JP | 2004051175 | A * | 2/2004 | ..... | B65B 53/02 |
| WO | WO 0236436 | * | 5/2002 | ..... | B65B 53/02 |

OTHER PUBLICATIONS

English translation of International Preliminary Report on Patentability PCT/EP2007/006750.

* cited by examiner

METHOD OF SHRINKING A HEAT SHRINKABLE FILM ONTO PRODUCT UNITS

CONTINUING APPLICATION DATA

This application is a Continuation-In-Part application of International Patent Application No. PCT/EP2007/006750, filed on Jul. 31, 2007, which claims priority from Federal Republic of Germany Patent Application No. 10 2006 036 590.9, filed on Aug. 4, 2006. International Patent Application No. PCT/EP2007/006750 was pending as of the filing date of this application. The United States was an elected state in International Patent Application No. PCT/EP2007/006750.

BACKGROUND

1. Technical Field

The present application relates to a method of shrink wrapping packs of containers and a shrink-wrapping arrangement for performing the method.

2. Background Information

Background information is for informational purposes only and does not necessarily admit that subsequently mentioned information and publications are prior art.

The present application relates to a method for heat-shrinking a shrink wrap film onto packs, whereby the heat-shrinking of the shrink wrap film of packs being moved a transport track is performed using a hot, gaseous media, for example hot air. The hot, gaseous medium forms at least one jet that is moved in conjunction with the respective pack by control action during heat-shrinking. The present application also relates to an apparatus for the heat-shrinking of a shrink wrap film to packs, having at least one jet of a hot, gaseous medium, for example having at least one jet of hot air, having at least one transport track on which the packs are moved during the heat-shrinking of the shrink wrap film, and having at least one discharge or nozzle opening for emitting the at least one jet of the hot, gaseous medium. The at least one jet of the hot, gaseous medium is moved in conjunction with the respective pack by control action during heat-shrinking for performing method of the present application.

Different types of packs, including for example in the form of trading units comprising multiple packaging units, are held together by means of shrink wrap film.

Packaging units include e.g. packs filled with a product and sealed, such as bottles and cans, but also product-filled packs made of a single or multi-ply sheet material, etc.

To create packs in the form of trading units, multiple packaging units are assembled into a trading unit group, which is then wrapped in shrink wrap and the shrink wrap exposed to a hot, gaseous medium, i.e. in practice heat-shrunk onto the trading unit group using hot air so that the packaging units are joined together to form the trading unit.

Heat-shrinking of the shrink wrap film is performed by moving the packs or trading unit on a conveyor through an apparatus configured as a shrink tunnel.

It is not always possible to heat-shrink the shrink wrap film to create crease-free packs, which are increasingly required to satisfy the more exacting requirements of consumers.

OBJECT OR OBJECTS

An object of the present application is to describe a method that can increase the effectiveness of the heat-shrinking of shrink wrap films onto packs and by means of which it is also possible to produce crease-free packs when heat-shrinking the shrink wrap film.

SUMMARY

A method for achieving this object is disclosed as a method for the heat-shrinking of a shrink wrap film onto packs, whereby the heat-shrinking of the shrink wrap film of packs being moved a transport track is performed using a hot, gaseous media, for example hot air. The hot, gaseous medium forms at least one jet that is moved in conjunction with the respective pack by control action during heat-shrinking.

An apparatus for performing the method is the subject of an apparatus for the heat-shrinking of a shrink wrap film to packs, having at least one jet of a hot, gaseous medium, for example having at least one jet of hot air, having at least one transport track on which the packs are moved during the heat-shrinking of the shrink wrap film, and having at least one discharge or nozzle opening for emitting the at least one jet of the hot, gaseous medium. The at least one jet of the hot, gaseous medium is moved in conjunction with the respective pack by control action during heat-shrinking.

A general feature of the present application lies in the fact that the at least one jet of the hot, gaseous medium, preferably the at least one hot air jet, used to heat-shrink the shrink wrap film, is moved in conjunction with the respective pack during the shrink wrap operation so that this jet is constantly aimed at the respective pack until the conclusion of said shrink wrap operation.

In a preferred embodiment of the present application, the at least one jet of the hot, gaseous medium is moved in conjunction with the respective pack such at this jet is aimed exclusively at one heat-shrink port during the shrink wrap operation.

This is created by leaving at least one lateral opening, for example, when wrapping the pack with the shrink wrap film, which opening remains as a heat-shrink port through which the at least one jet of hot, gaseous medium enters the wrapper enclosing the pack and formed by the shrink wrap, thus causing the shrink wrap to shrink from the inside out.

The at least one jet is moved in conjunction with the pack by control action so that it enters the heat-shrink port as close to center as possible and so that this jet is not pierced or transected by overhanging shrink wrap or shrink wrap edges/corners.

The at least one jet of the hot, gaseous medium aimed into the heat-shrink port causes the shrink wrap film on the at least one packaging unit to initially inflate due to a back pressure and lift off of the pack so that the shrink wrap film can enclose the at least one packaging unit crease-free during the shrink wrap operation.

The controlled movement of the at least one jet of the hot, gaseous medium in conjunction with the respective pack can be accomplished in a variety of ways, for example by moving at least one nozzle opening for discharging the hot, gaseous medium in conjunction with the respective pack, or by providing a nozzle arrangement having a plurality of controlled discharge or nozzle openings for the hot, gaseous medium, and which arrangement is moved along the transport path on which the pack is moved during the shrink wrap operation.

The nozzle openings are activated and deactivated by computer control such that only one or multiple nozzle openings at that point along the transport path where a pack is located are activated for the discharge of the jet of hot, gaseous medium so that the jet of the hot, gaseous medium emerging from the at least one activated nozzle opening enters the heat-shrink port of the respective pack.

Activation and deactivation of the nozzle openings is by means of controlled slide valves or orifices.

Also possible is the provision of a plurality of individually-controlled nozzles comprising the nozzle openings.

Further embodiments of the present application are disclosed below.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Possible embodiments of the present application are described in greater detail below illustrated with the accompanying drawings, in which.

DESCRIPTION OF EMBODIMENT OR EMBODIMENTS

In the figures, 1 are trading, shipping, or multi-pack units, each comprising multiple packaging units 2, namely in the embodiment shown a total of six packaging units in the form of bottles, a carrier 3 for these packaging units and a packaging or shrink wrap film 4 heat-shrunk onto the packaging units 2 and the carrier 3 and thus the trading unit 1. Other packaging units could be containers, cans, or boxes.

Figure 1:
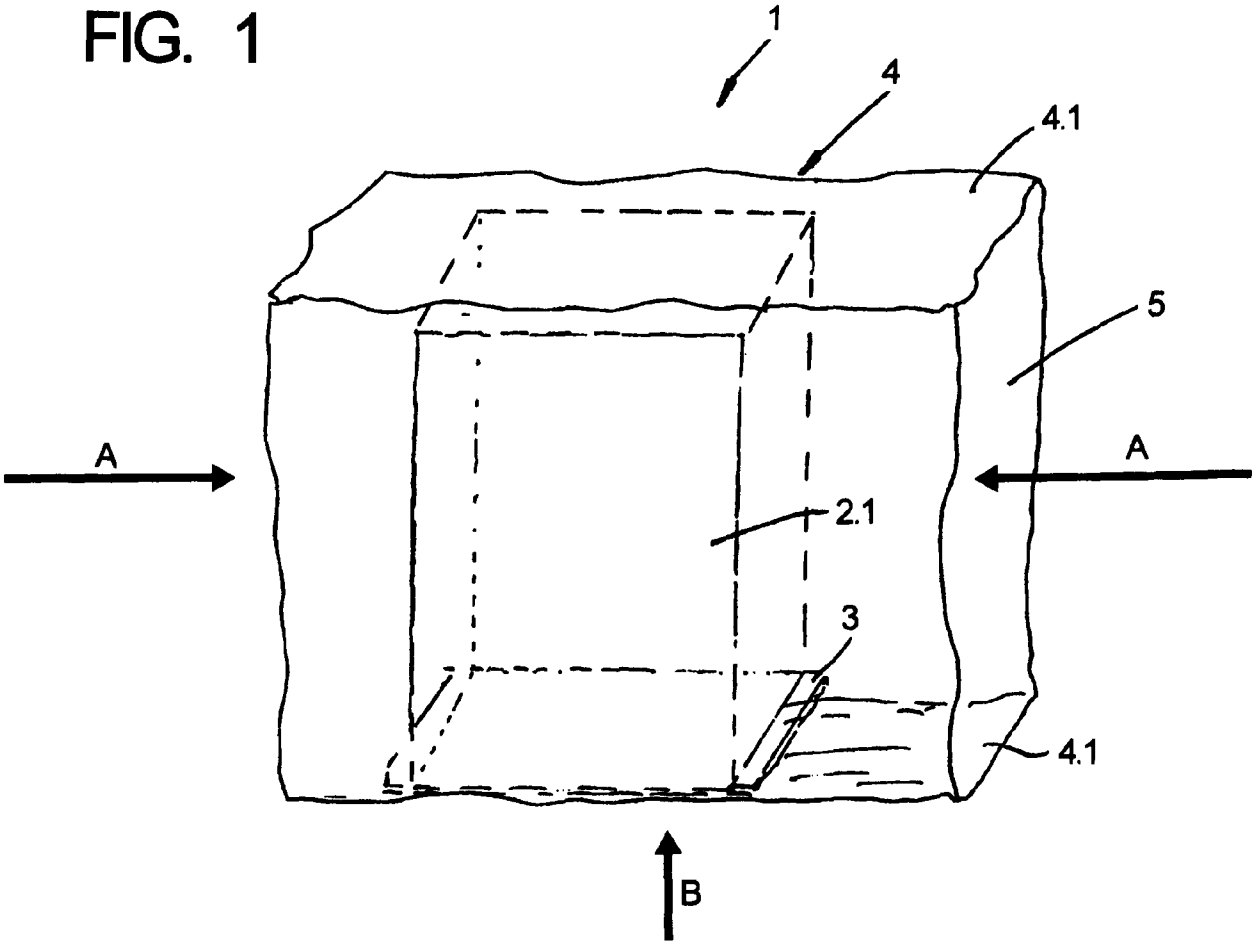
FIG. 1 shows a schematic, perspective view of a pack in the form of a trading unit with shrink wrap film, but prior to the heat-shrinking of this film.

In the interest of simplifying the view, the packaging units 2 of the trading unit 1 are shown together in FIG. 1 as a volume 2.1.

To form the trading unit, the shrink wrap film 4 is wrapped around the trading unit comprising the packaging units 2 and the carrier in an apparatus not shown here but known to a practitioner skilled in the art so that the shrink wrap film encloses each trading unit 1 at the top and the bottom but initially leaving each trading unit 1 open on two opposing sides, forming a so-called heat-shrink port 5, which port is enveloped by a film overhang 4.1.

Overlapping ends of the shrink wrap film 4 created during wrapping are located on the underside of the carrier 3 facing away from the packing units 2.

The shrink wrap film 4 is heat-shrunk using lateral hot air jets A, each of which is aimed at one heat-shrink port 5. The resulting back pressure slightly raises the shrink wrap film 4 from the packaging units and also laterally away from the carrier 3 by approximately twenty to thirty centimeters, for example. Among other things, this essentially ensures or promotes that the energy input by the hot air is applied to the inside of the shrink wrap film 4 for optimal heat-shrinking of this film onto the trading unit 1. To achieve crease-free or substantially crease-free heat-shrinking of the shrink wrap film 4, it is also important that the respective hot air jet A coming from the side is aimed as closely as possible, or substantially closely, to the center of the heat-shrink port 5 and not at the edges surrounding the heat-shrink port 5 or at the film overhangs 4.1.

The shrink wrap film 4 is sealed on the underside of the trading unit 1 or the carrier 3 by means of hot air jets aimed at this underside, as is indicated by the arrows B in FIG. 1.

Figure 2:
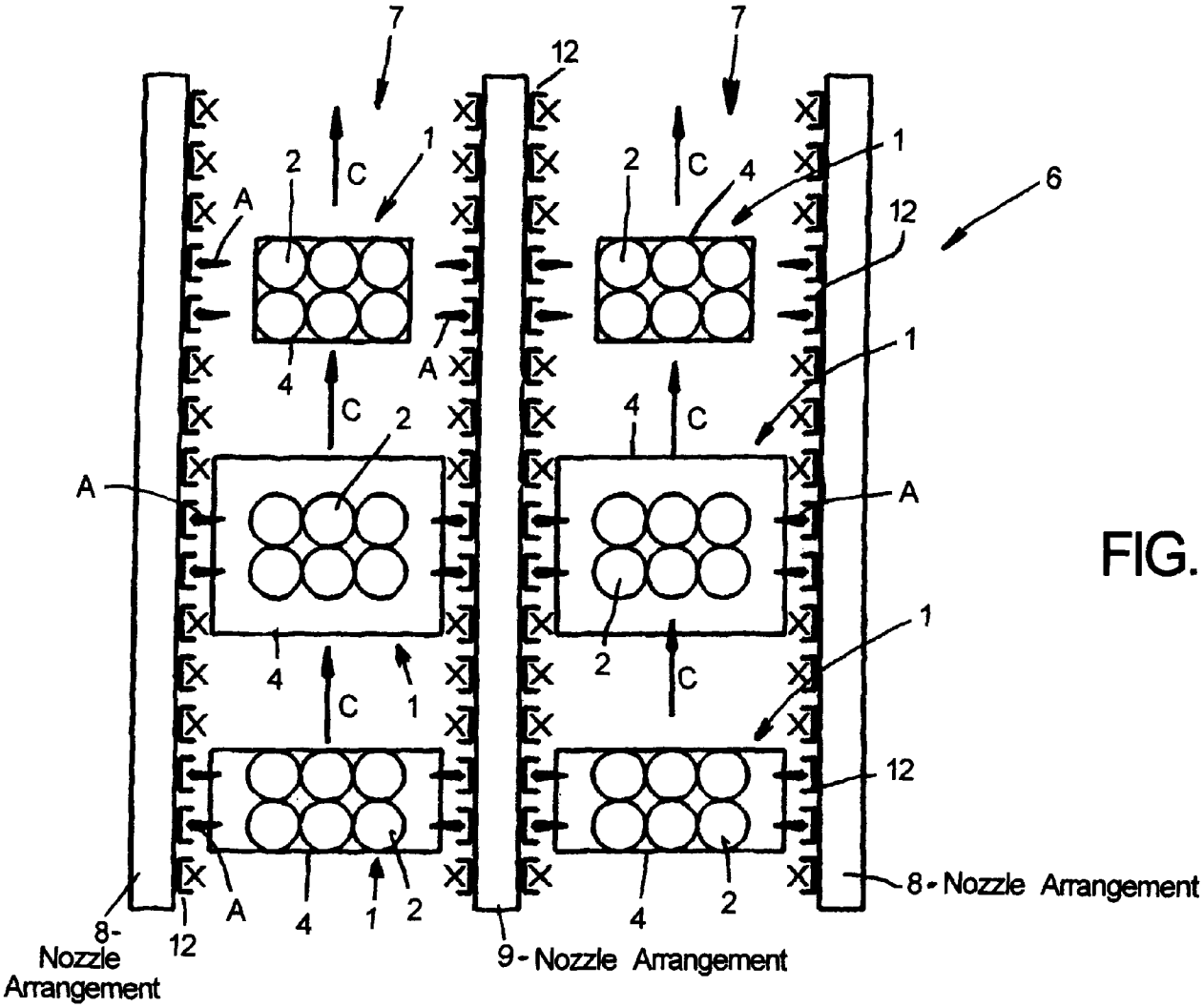
FIG. 2 shows a simplified plan view of an apparatus for heat-shrinking a shrink wrap film onto the trading unit.
Figure 3:
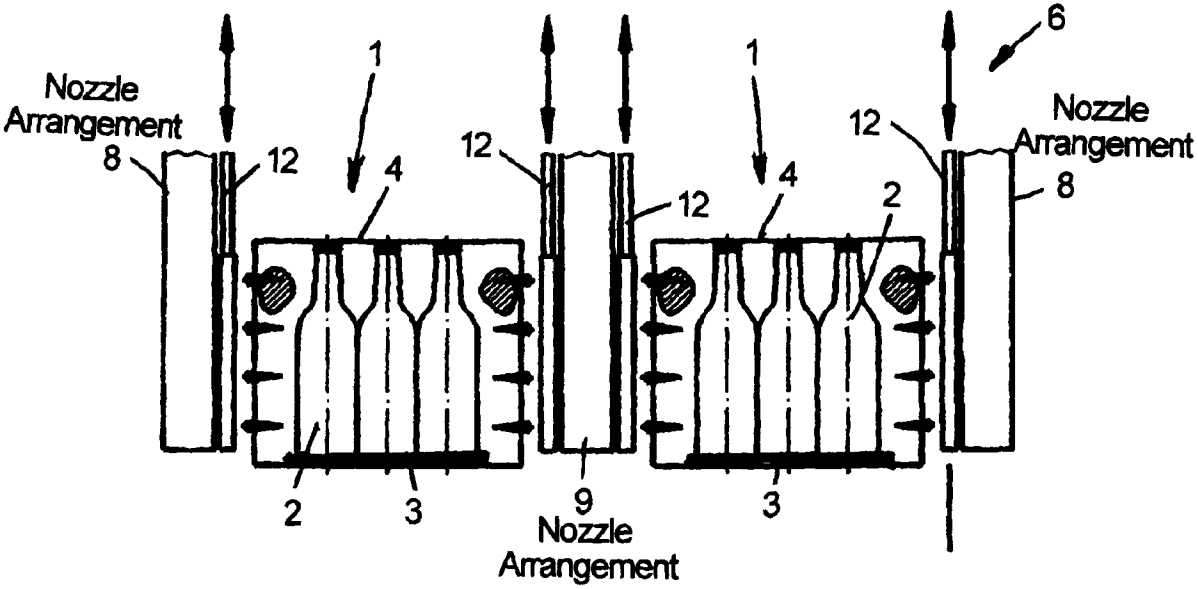
FIG. 3 shows a cross-section of the apparatus shown in FIG. 2.
Figure 4:
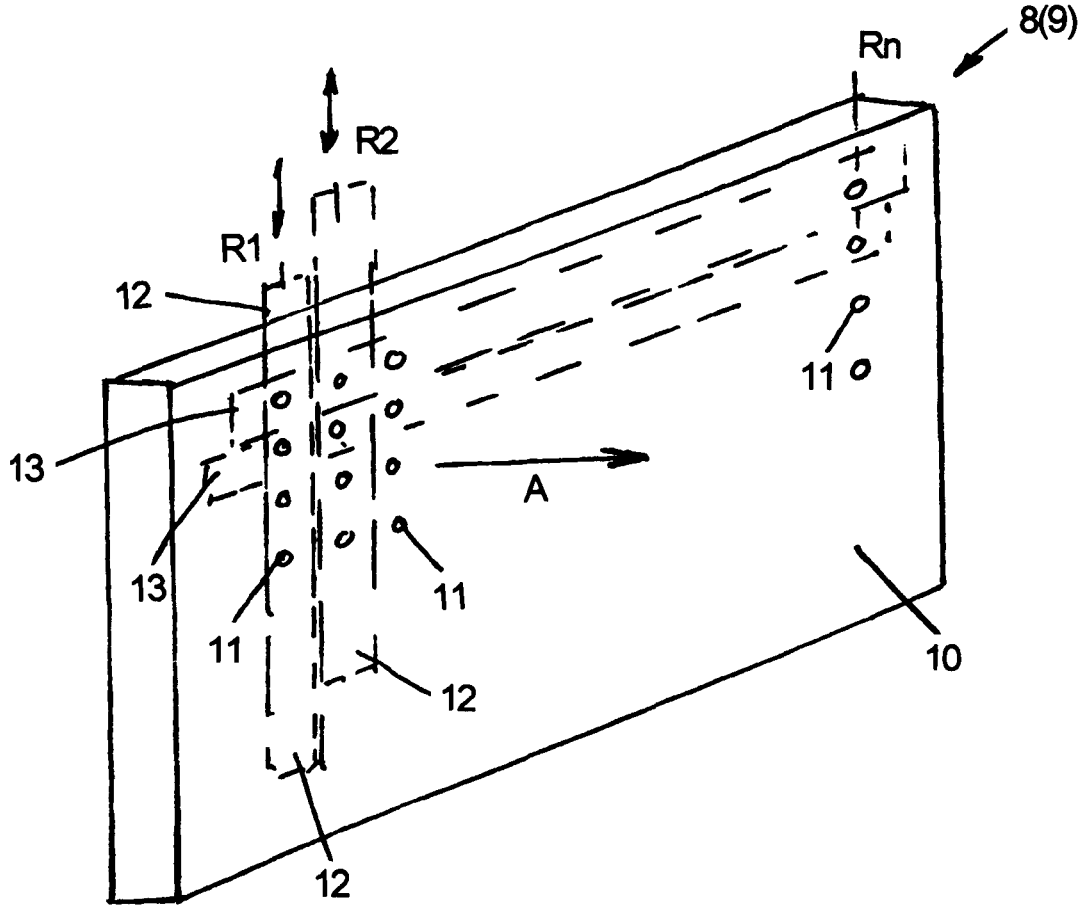
FIG. 4 shows in simplified form the nozzle arrangement for applying the hot air jets for heat-shrinking the shrink wrap film.

FIGS. 2 and 3 show an apparatus 6 for fixing the trading unit by the heat-shrinking of the shrink wrap film 4.

The apparatus 6 is configured as a shrink tunnel, through which the trading unit 1 wrapped in shrink wrap film 4 is passed, in one possible embodiment on a conveyor belt 7 in a horizontal direction of transport C.

In the embodiment shown, the apparatus 6 is configured as a two-track unit with two parallel or virtually parallel conveyor belts.

A nozzle arrangement 8 and 9 is located on both sides of the transport path of each conveyor belt 7.

In the embodiment shown, each nozzle arrangement comprises a closed distribution channel 10 extending in the direction of transport C, which channel is connected to a hot air source not shown in the figures and which channel extends in the vertical direction to a height that is at least equal to the maximum height of the trading unit 1 to be processed with the apparatus 6.

The outer nozzle arrangements 8 have a plurality of discharge or nozzle openings 11 for hot air on that side of the distribution channel 10 facing the respective conveyor belt, arranged in a vertical plane and extending in the direction of transport C. The distribution channel 10 of the nozzle arrangement 9 has these nozzle openings 11 on both sides, each of which is arranged in vertical planes and extends in the direction of transport. The discharge openings 11 are distributed such that they form multiple vertical rows R1-Rn, in which the nozzle openings 11 are tightly packed and arranged in close sequence in the vertical direction.

There is one slide valve 12 for each row R1-Rn or each group of two or more than two rows, which slide valve 12 is controlled by an independent actuator, e.g. in the form of pneumatic cylinder, and can be moved so that the nozzle openings 11 are closed by the slide valve 12 when the same is in one state and open when the slide valve is in the other state.

By actuating the individual slide valves 12 via an electronic controller, e.g. via a computer, the nozzle openings 11 of the individual rows R1-Rn can be opened and closed synchronously with the motion of the conveyor belts 7 so that the hot air jet A aimed at the trading unit 1 from the side moves in conjunction with this trading unit 1 or the respective trading unit until the conclusion of the shrink wrap operation without the edges and overhangs of the shrink wrap film 4.1 surrounding the heat-shrink port intersecting the respective hot air jet A, but rather the hot air jet is directed from the side to the center of the open heat-shrink port.

Control of the slide valves may be performed by means of sensors, for example, that deliver a signal corresponding to the respective position of the trading unit 1 and/or by allowing for the transport speed of the conveyor belts 7, which is also measured by sensors.

To enable the device 6 to also process trading units 1 of different heights, means are provided by which the height of the rows R1-Rn active during the heat-shrink operation can be adjusted to the height of the trading unit 1. For example, this is made possible by providing horizontally mobile slide valves 13 in addition to the slide valves 12, by means of which slide valves 13 a certain number of nozzle openings 11 of each row R1-Rn can be activated or deactivated. It is also possible to subdivide the respective distribution chamber 10 of the nozzle arrangements 8 and/or 9 into multiple subchambers extending in the direction of transport C and separated from one another, which can then be activated or deactivated to adjust for the height of the trading unit 1, i.e. to match the format.

Instead of nozzle openings 11 actuated via slide valves 12 and/or 13, it is also possible to configure each nozzle opening as an individually controlled hot air nozzle, so that these individual nozzles are opened and closed by computer in such a manner that the hot air jets A aimed from the side at the trading unit 1 or its heat-shrink port move in conjunction with the trading units 1 in the direction of transport C, and the number and position of activated nozzles correspond to the position and shape and/or size of the trading unit 1 or the heat-shrink ports on these trading units.

Figure 5:
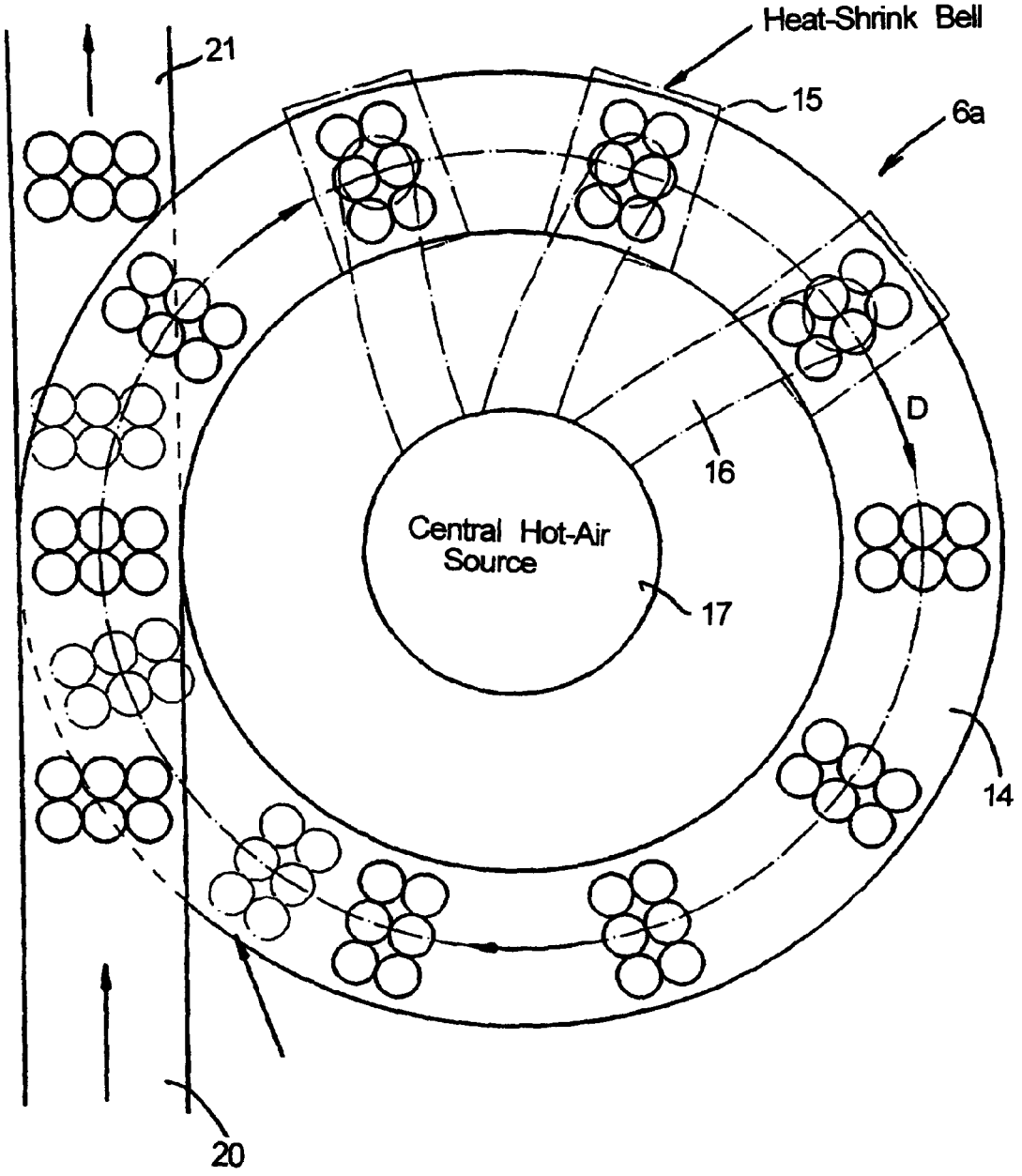
FIG. 5 shows a plan view of another apparatus for heat-shrinking the shrink wrap film.

FIG. 5 shows a schematic of an apparatus 6*a* with which the heat-shrinking of the shrink wrap film 4 onto the trading unit 1 occurs in a carousel system 14, on which the trading unit 1 is transported on a circular track encircling a vertical machine axis (arrow D) during the heat-shrinking of the shrink wrap film 4.

Provided above the carousel system 14 or above a support surface for the trading unit formed by this carousel system are heat-shrink bells 15, which are moved in conjunction with the trading units on or in the carousel system 14 and which are each connected by means of a hose or a tubular connection 16 to a hot air source 17 arranged in the center of the carousel system 14.

Figure 6:
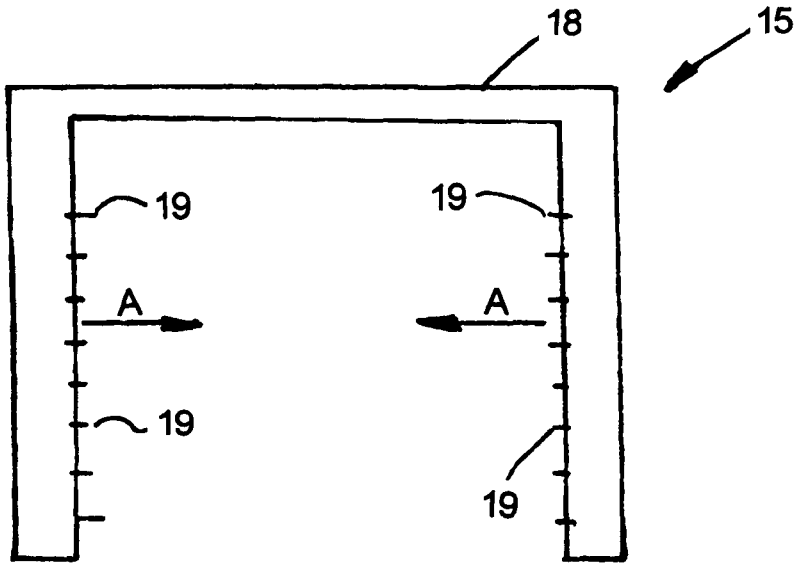
FIG. 6 shows a schematic view of a heat-shrinking bell of the apparatus shown in FIG. 5.

The heat-shrink bells 15 are configured as shown in FIG. 6, for example, i.e. they comprise a frame 18 having nozzle openings 19 for the discharge of the hot air jets A configured in such a manner that, in the embodiment shown, the hot air jets A are aimed in an axial direction radial or substantially radial to the vertical machine axis or to the axis of rotation of the carousel system 14, and in one possible embodiment radially to the outside or radially to the inside.

The trading units 1 with the shrink wrap film 4 are delivered to the apparatus 6*a* via a conveyor 20 so that each trading unit 1 on the carousel system 14 is arranged under a heat-shrink bell 15, and the heat-shrink ports 5 are radially outward or radially inward relative to the axis of rotation of the carousel system 14.

Because the heat-shrink bells 15 move in conjunction with the carousel system 14 and the trading units 1 arranged thereon, it is essentially ensured or promoted that the hot air jets A blow on the center of the heat-shrink ports 5 during the heat-shrinking.

After heat-shrinking of the shrink wrap film 4, the trading units 1 on the carousel system 14 are lowered and are then transferred in the lowered or descended position to the conveyor 21 and transported away.

Figure 7:
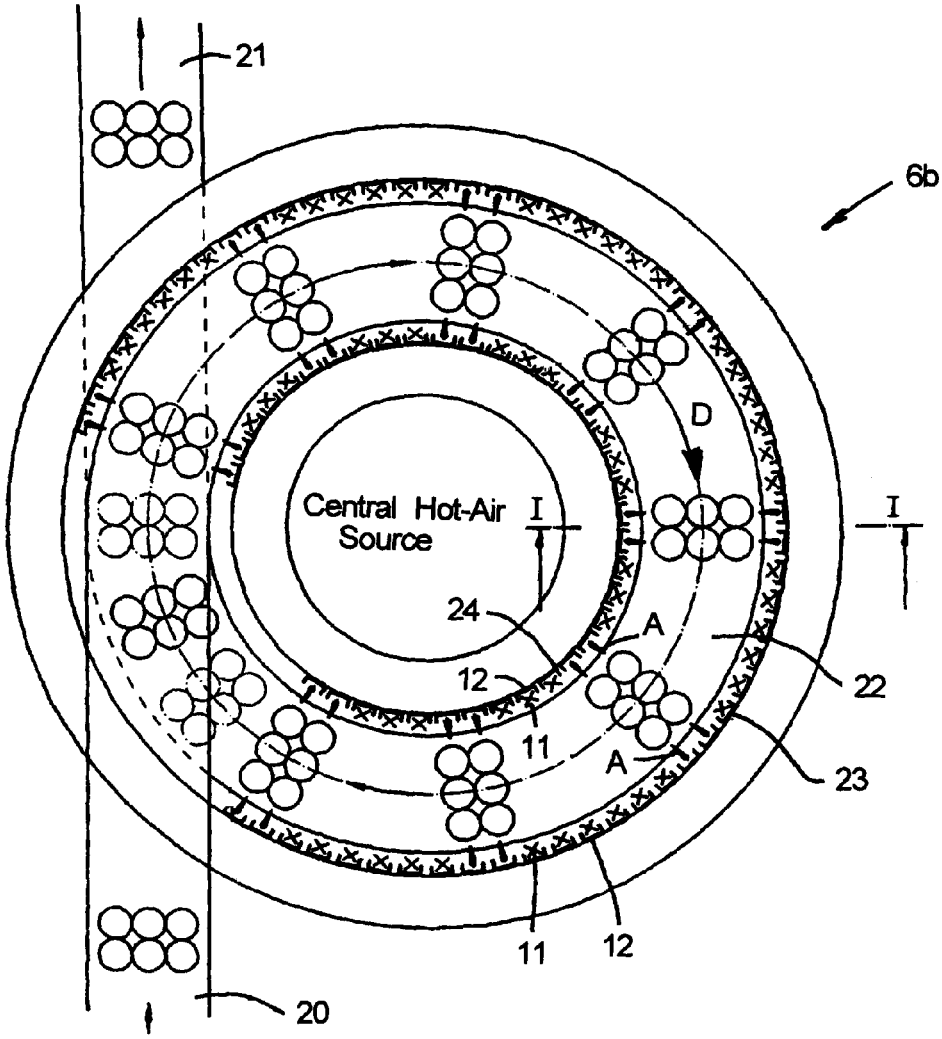
FIG. 7 shows a plan view of another apparatus for heat-shrinking the shrink wrap film.
Figure 8:
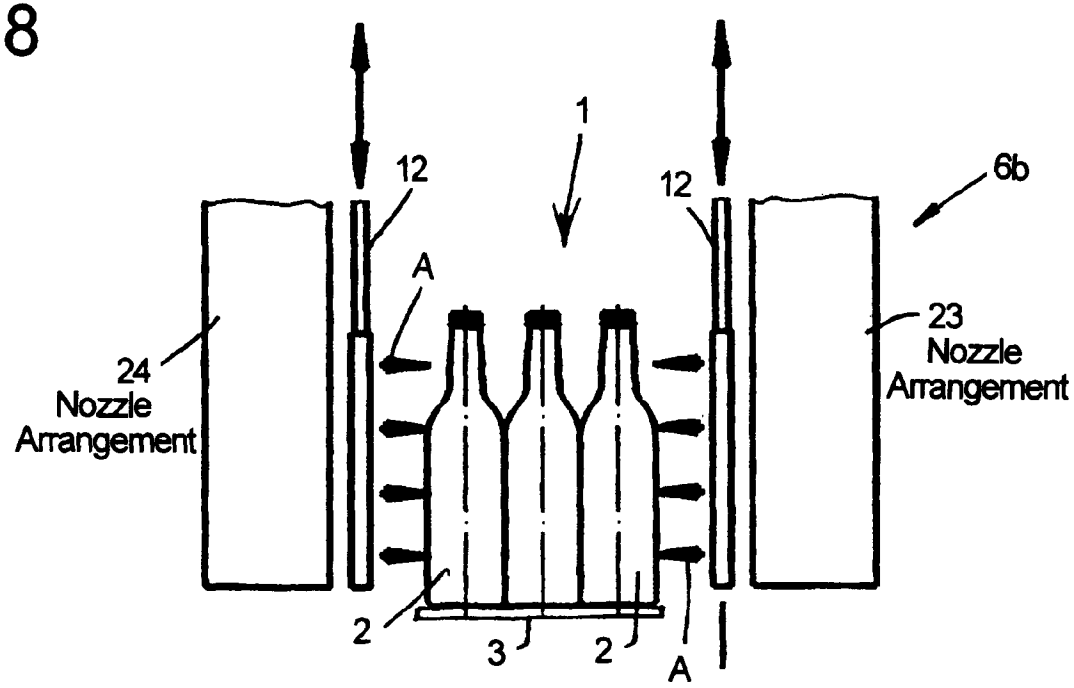
FIG. 8 shows a simplified view of a section corresponding to the line I-I in FIG. 7.

FIGS. 7 and 8 show as additional embodiments an apparatus 6*b*, with which the heat-shrinking of the shrink wrap film 4 onto the trading units 1 is performed as these trading units are moved around a circular track encircling the vertical machine axis by means of a carousel system 22.

The apparatus 6*b* differs from apparatus 6*a* from FIGS. 5 and 6 in that there are no heat-shrink bells that move in conjunction with the carousel system 22, rather there is one nozzle arrangement 23 and 24 on the inside and outside, respectively, of a circular transport path formed by the carousel system 22.

These are configured like the nozzle arrangements 8 and 9, but are semicircular in shape.

The outer nozzle arrangement 23 faces inward and the inner nozzle arrangement 24 faces outward; both have a plurality of controlled nozzle openings 11.

The nozzle openings 11 are, in turn, arranged sequentially in multiple vertical rows in the direction of transport D of the carousel system 22, and by means of slide valves corresponding to the slide valves 12 and 13 can be actuated synchronously with the motion of the trading units 1 on the carousel system 22 so that the hot air jets A discharged through the nozzle openings 11 are precisely or generally aimed as closely as possible to the center of the respective heat-shrink port 5, and move in conjunction with the trading units 1 to essentially ensure or promote this.

The slide valve corresponding to the slide valves 13 enables adjustments for various formats, i.e. an adjustment for the height of the trading units 1.

The nozzle openings 11 can also be configured as individually controlled single nozzles or hot air nozzles, which are then controlled so that the hot air jets A move as required or desired in conjunction with the movement of the trading units 1 on the carousel system 22, with control by means of sensor signals defining the position of the trading units 1 on the carousel system 22.

Following the heat-shrink operation, the trading units 1 are lowered and are transferred in this lowered position to the conveyor 21.

Figure 9:
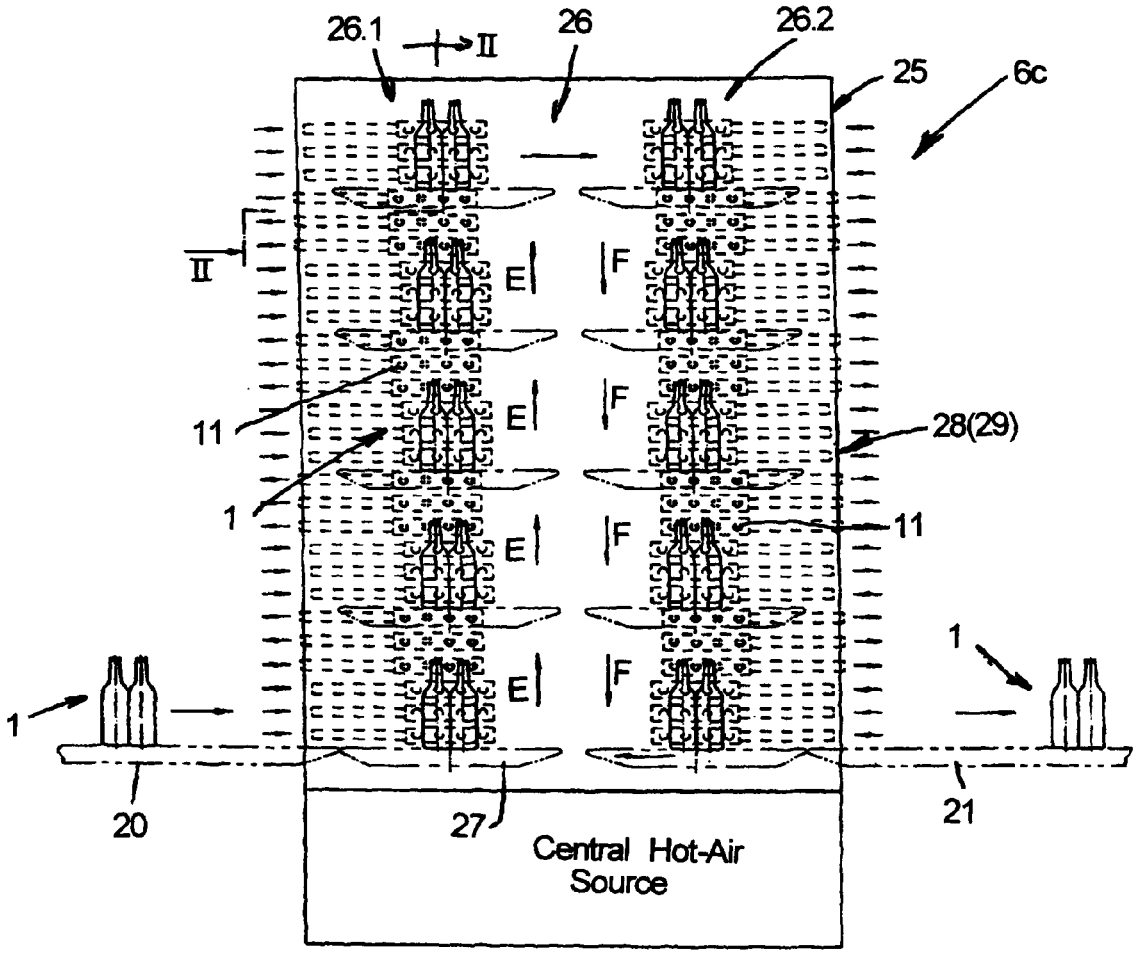
FIG. 9 shows a simplified view of another apparatus in the form of a elevator or lift system for heat-shrinking the shrink wrap film.
Figure 10:
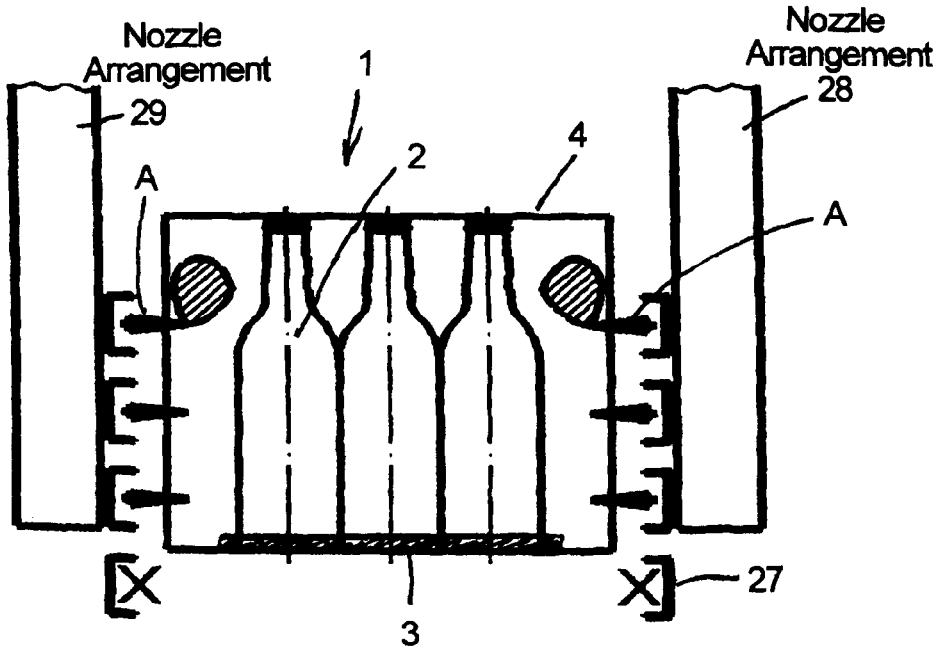
FIG. 10 shows a section corresponding to the line I-I in FIG. 9.

FIGS. 9 and 10 show an apparatus 6*c*, with which the trading units 1 are moved for heat-shrinking of the shrink wrap film 4 over a transport track 26 configured as an elevator or lift system 25.

The trading units 1 are delivered to the apparatus 6*c* via the conveyor 20 and removed from the apparatus 6*c* via the conveyor 21 following heat-shrinking of the shrink wrap film.

Inside the apparatus 6*c*, each of the trading units 1 is carried upward in the vertical direction (arrow E) in one segment 26.1 of the transport track 26 and then carried together with the trading unit carrier 27 on which it is standing downward in the vertical direction (arrow F) in the segment 26.2 of the transport track 26 to the exit of the apparatus 6*c*.

Nozzle arrangements 28 and 29, each with a plurality of controlled nozzle openings 11, are provided on two opposing sides of the transport track 26 for the lateral discharge of hot air jets A against the trading units 1 or their heat-shrink ports.

To this end, the trading units 1 are delivered to the apparatus 6*c* so that the heat-shrink ports 5 face the sides of the transport track 26 having the nozzle openings 11.

The nozzle openings 11 are controlled so that the lateral hot air jets A are aimed precisely or generally at the center of the heat-shrink ports 5 and move in conjunction with the movement of the trading units (arrows E and F).

This is achieved by the controlled movement of the slide valves, for example, which are moved horizontally to open and close the nozzle openings 11 synchronously with the movement of the trading units 1, i.e. parallel or virtually parallel thereto, so that only or mostly only those nozzle openings 11 corresponding to the location of a heat-shrink port of a trading unit are opened.

In this embodiment, the nozzle openings 11 are arranged sequentially in multiple vertical rows in the horizontal direction, whereby the nozzle openings 11 in each row are closely spaced top-to-bottom and side-to-side.

Adjustments for different horizontal dimensions of the trading units are performed by means of additional slide valves that can be actuated in the vertical direction to open or close the nozzle openings 11, for example.

This embodiment can also include nozzle openings 11 configured as individually controlled single or hot air nozzles that are actuated synchronously with the movement of the trading units 1 by means of an electronic controller such as a computer.

The present application was described above with reference to one possible embodiment.

It will be understood that numerous modifications and derivations are possible without departing from the teaching on which the present application is based.

For example, it was assumed above that each trading unit 1 has a carrier 3.

It is understood that this is not required.

Trading units 1 can also solely or mostly comprise the packaging units 2 and the shrink wrap film 4 holding these units together.

Method for heat-shrinking a shrink wrap film onto at least one packaging unit to which the shrink wrap film is applied and which is moved on a transport track during heat-shrinking using at least one jet of a hot, gaseous medium, for example using at least one hot air jet.

One feature or aspect of an embodiment is believed at the time of the filing of this patent application to possibly reside broadly in a method for the heat-shrinking of a shrink wrap film onto packs 1, whereby the heat-shrinking of the shrink wrap film 4 of packs 1 being moved a transport track 7, 14, 22, 26 is performed using a hot, gaseous media, for example hot air, wherein the hot, gaseous medium forms at least one jet A that is moved in conjunction with the respective pack 1 by control action during heat-shrinking.

Another feature or aspect of an embodiment is believed at the time of the filing of this patent application to possibly reside broadly in the method, wherein the packs are trading units 1 comprising multiple packaging units 2.

Yet another feature or aspect of an embodiment is believed at the time of the filing of this patent application to possibly reside broadly in the method, wherein the at least one jet A of the hot, gaseous medium is aimed at the packs 1 horizontally or vertically perpendicular or virtually perpendicular to the direction of movement C, D, E, F of the transport track 7, 14, 22, 26.

Still another feature or aspect of an embodiment is believed at the time of the filing of this patent application to possibly reside broadly in the method, wherein the at least one jet A of the hot, gaseous medium is aimed at at least one side of the packs 1 being moved on the transport track 7, 14, 22, 26.

A further feature or aspect of an embodiment is believed at the time of the filing of this patent application to possibly reside broadly in the method, wherein at least one jet A of the hot, gaseous medium is aimed at at least two opposing sides of each pack 1.

Another feature or aspect of an embodiment is believed at the time of the filing of this patent application to possibly reside broadly in the method, wherein the packs 1 are wrapped in the shrink wrap film 4 in such a manner that the wrapper formed by the shrink wrap film 4 forms at least one opening as a heat-shrink port 5, and that at least one jet A of the hot, gaseous medium is moved by control action in conjunction with the respective pack 1 so that it is aimed at the heat-shrink port 5 during heat-shrinking.

Yet another feature or aspect of an embodiment is believed at the time of the filing of this patent application to possibly reside broadly in the method, wherein the wrapping of the packs 1 in the shrink wrap film 4 is performed in such a manner that one opening is formed as a heat-shrink port 5 on each of two opposing sides, and that at least one jet A of the hot, gaseous medium moved by control action in conjunction with the respective pack 1 is aimed at each heat-shrink port 5.

Still another feature or aspect of an embodiment is believed at the time of the filing of this patent application to possibly reside broadly in the method, wherein the at least one jet A of the hot, gaseous medium is moved in conjunction with the respective pack 1 so that it remains aimed exclusively at the heat-shrink port 5 until the conclusion heat-shrinking.

A further feature or aspect of an embodiment is believed at the time of the filing of this patent application to possibly reside broadly in the method, wherein the at least one jet A of the hot, gaseous medium is moved in conjunction with the respective pack 1 wrapped in shrink wrap film 4 in such a manner as to prevent restrict, and/or minimize the piercing or transaction of this jet A outside the heat-shrink port 5 by shrink wrap film overhangs 4.1 and/or shrink wrap edges/corners.

One feature or aspect of an embodiment is believed at the time of the filing of this patent application to possibly reside broadly in the method, wherein the at least one jet A of the hot, gaseous medium is produced by at least one nozzle arrangement 8, 9, 23, 24, 28, 29 extending along the transport track 7, 22, 26 and having a plurality of discharge or nozzle openings 11 arranged sequentially in the direction of transport or movement C, D, E, F of the transport track 7, 22, 26, and that the nozzle openings 11 are moved synchronously with the movement of the packs 1 by control action so that only or mostly only those nozzle openings 11 that emit a jet A of the hot, gaseous medium striking the respective pack 1 are activated.

Another feature or aspect of an embodiment is believed at the time of the filing of this patent application to possibly reside broadly in the method, wherein only or mostly only those nozzle openings 11 for emitting the jet A of the hot, gaseous medium are activated whose jet A is aimed at the heat-shrink port 5 of the respective pack, in one possible embodiment at the center of this heat-shrink port 5.

Yet another feature or aspect of an embodiment is believed at the time of the filing of this patent application to possibly reside broadly in the method, wherein the nozzle openings 11 of the nozzle arrangement 8, 9, 23, 24, 28, 29 are arranged in multiple rows R1-Rn, with multiple nozzle openings 11 in each row, and that at least one, but in one possible embodiment multiple nozzle openings 11 are progressively activated and deactivated from row to row synchronously with the movement of the respective pack 1 for the conjunctive movement the at least one jet A of the hot, gaseous medium.

Still another feature or aspect of an embodiment is believed at the time of the filing of this patent application to possibly reside broadly in the method, wherein the nozzle openings 11 are actuated via orifices or slide valves 12, 13.

A further feature or aspect of an embodiment is believed at the time of the filing of this patent application to possibly reside broadly in the method, wherein the nozzle openings 11 are configured as controlled single nozzles.

Another feature or aspect of an embodiment is believed at the time of the filing of this patent application to possibly reside broadly in the method, wherein the activation and deactivation of the nozzle openings 11 is by means of an electronic controller, e.g. a computer, as a function of the position of the respective pack 1.

Yet another feature or aspect of an embodiment is believed at the time of the filing of this patent application to possibly reside broadly in the method, wherein at least one nozzle arrangement 8, 9, 23, 24, 28, 29 with a plurality of controlled nozzle openings 11 is provided on two opposing sides of the transport track 7, 22, 26.

Still another feature or aspect of an embodiment is believed at the time of the filing of this patent application to possibly reside broadly in the method, wherein at least one nozzle opening 19 or a group of nozzle openings 19 for emitting the at least one jet A of the hot, gaseous medium is moved in conjunction with the respective pack 1.

A further feature or aspect of an embodiment is believed at the time of the filing of this patent application to possibly reside broadly in the method, wherein the at least one nozzle opening 19 is on a heat-shrink dome 15 that is moved in conjunction with the transport track 14.

One feature or aspect of an embodiment is believed at the time of the filing of this patent application to possibly reside broadly in the method, wherein the transport track is an essentially linear transport track 7.

Another feature or aspect of an embodiment is believed at the time of the filing of this patent application to possibly reside broadly in the method, wherein the transport track 14, 22 is circular, such as a transport track formed by a carousel system 14, 22.

Yet another feature or aspect of an embodiment is believed at the time of the filing of this patent application to possibly reside broadly in the method, wherein an elevator or lift system 26 forms the transport track 26.

Still another feature or aspect of an embodiment is believed at the time of the filing of this patent application to possibly reside broadly in an apparatus for the heat-shrinking of a shrink wrap film to packs 1, having at least one jet A of a hot, gaseous medium, for example having at least one jet of hot air, having at least one transport track 7, 14, 22, 26 on which the packs are moved during the heat-shrinking of the shrink wrap film 4, and having at least one discharge or nozzle opening 11, 19 for emitting the at least one jet A of the hot, gaseous medium, wherein the at least one jet A of the hot, gaseous medium is moved in conjunction with the respective pack 1 by control action during heat-shrinking.

A further feature or aspect of an embodiment is believed at the time of the filing of this patent application to possibly reside broadly in the apparatus, wherein the at least one nozzle opening 11, 19 is oriented so that the at least one jet A of the hot, gaseous medium is aimed at the packs 1 horizontally or vertically perpendicular or virtually perpendicular to the direction of movement C, D, E, F of the transport track 7, 14, 22, 26.

Another feature or aspect of an embodiment is believed at the time of the filing of this patent application to possibly reside broadly in the apparatus, wherein the at least one nozzle opening 11, 19 is oriented so that the at least one jet A of the hot, gaseous medium is aimed at at least one side of the respective packs 1.

Yet another feature or aspect of an embodiment is believed at the time of the filing of this patent application to possibly reside broadly in the apparatus, wherein there are at least two opposing nozzle openings 11, 19.

Still another feature or aspect of an embodiment is believed at the time of the filing of this patent application to possibly reside broadly in the apparatus, wherein the at least one jet A of the hot, gaseous medium is moved in conjunction with the respective packs 1 by control action so that it remains aimed exclusively at the heat-shrink port 5 of the respective pack 1 during heat-shrinking.

A further feature or aspect of an embodiment is believed at the time of the filing of this patent application to possibly reside broadly in the apparatus, wherein there is at least one nozzle arrangement 8, 9, 23, 24, 28, 29 extending along the transport track 7, 22, 26 and having a plurality of discharge or nozzle openings 11 arranged sequentially in the direction of transport or movement C, D, E, F of the transport track 7, 22, 26, also wherein there is a means of controlling the nozzle openings 11 synchronously with the movement of the packs 1 so that only or mostly only those nozzle openings 11 that emit a jet A of the hot, gaseous medium striking the respective pack 1 are activated.

One feature or aspect of an embodiment is believed at the time of the filing of this patent application to possibly reside broadly in the apparatus, wherein the nozzle openings 11 of the nozzle arrangement 8, 9, 23, 24, 28, 29 are arranged in multiple rows R1-Rn, with multiple nozzle openings 11 in each row, and that at least one, but in one possible embodiment multiple nozzle openings 11 are progressively activated from row to row synchronously with the movement of the respective pack 1 for the conjunctive movement the at least one jet A of the hot, gaseous medium.

Another feature or aspect of an embodiment is believed at the time of the filing of this patent application to possibly reside broadly in the apparatus, wherein the nozzle openings 11 are actuated via orifices or slide valves 12, 13.

Yet another feature or aspect of an embodiment is believed at the time of the filing of this patent application to possibly reside broadly in the apparatus, wherein the nozzle openings 11 are configured as controlled individual nozzles.

Still another feature or aspect of an embodiment is believed at the time of the filing of this patent application to possibly reside broadly in the apparatus, comprising an electronic controller, e.g. a computer, for the controlled activation and deactivation of the nozzle openings 11 as a function of the position of the respective pack 1.

A further feature or aspect of an embodiment is believed at the time of the filing of this patent application to possibly reside broadly in the apparatus, wherein at least one nozzle arrangement 8, 9, 23, 24, 28, 29 with a plurality of controlled nozzle openings 11 is provided on two opposing sides of the transport track 7, 22, 26.

Another feature or aspect of an embodiment is believed at the time of the filing of this patent application to possibly reside broadly in the apparatus, wherein at least one nozzle opening 19 or a group of nozzle openings 19 for emitting the at least one jet A of the hot, gaseous medium is moved in conjunction with the respective pack 1.

Yet another feature or aspect of an embodiment is believed at the time of the filing of this patent application to possibly reside broadly in the apparatus, wherein the at least one nozzle opening 19 is on a heat-fit bell 15 that is moved in conjunction with the transport track 14.

Still another feature or aspect of an embodiment is believed at the time of the filing of this patent application to possibly reside broadly in the apparatus, wherein the transport track is an essentially linear transport track 7.

A further feature or aspect of an embodiment is believed at the time of the filing of this patent application to possibly reside broadly in the apparatus, wherein the transport track 14, 22 is circular, such as a transport track formed by a carousel system 14, 22.

One feature or aspect of an embodiment is believed at the time of the filing of this patent application to possibly reside broadly in the apparatus, wherein an elevator or lift system 26 forms the transport track 26.

Another feature or aspect of an embodiment is believed at the time of the filing of this patent application to possibly reside broadly in a method of shrink wrapping packs of containers, said method comprising the steps of: moving a first pack of containers into a shrink-wrapping arrangement; wrapping a first piece of shrink wrap film around said first pack of containers and substantially simultaneously forming at least two openings in said first piece of shrink wrap film to leave a portion of the surfaces of said first pack of containers open and uncovered by said first piece of shrink wrap film; and moving said first pack of containers wrapped in said first piece of shrink wrap film in said shrink-wrapping arrangement while substantially simultaneously heat shrinking said first piece of shrink wrap film around said first pack of containers by substantially solely continuously directing substantially all of a heated gaseous medium directed at said first pack of containers through said at least two openings and into the interior of said first piece of shrink wrap film.

Another feature or aspect of an embodiment is believed at the time of the filing of this patent application to possibly reside broadly in the method which further comprises the steps of: moving a second pack of containers into said shrink-wrapping arrangement; wrapping a second piece of shrink wrap film around said second pack of containers and substantially simultaneously forming at least two openings in said second piece of shrink wrap film to leave a portion of the surfaces of said second pack of containers open and uncovered by said second piece of shrink wrap film; and moving said second pack of containers wrapped in said second piece of shrink wrap film in said shrink-wrapping arrangement while substantially simultaneously heat shrinking said second piece of shrink wrap film around said second pack of containers by substantially solely continuously directing substantially all of a heated gaseous medium directed at said second pack of containers through said at least two openings and into the interior of said second piece of shrink wrap film, which said step of heat shrinking said second piece of shrink wrap being performed substantially simultaneously to said step of heat shrinking said first piece of shrink wrap.

Yet another feature or aspect of an embodiment is believed at the time of the filing of this patent application to possibly reside broadly in the method, wherein said step of directing said gaseous medium comprises: moving said first and second packs of bottles on a conveyor; directing said gaseous medium at opposite sides of a pack of containers and perpendicular to the direction of movement of said conveyor; directing said gaseous medium to minimize interruption or disruption of the flow of gaseous medium by portions of said shrink wrap film disposed about or adjacent said at least two openings; directing said gaseous medium using a nozzle arrangement comprising a plurality of nozzle openings arranged sequentially in the direction of movement of said conveyor; activating only nozzle openings disposed adjacent said packs to direct all of said gaseous medium directed at said packs through said at least two openings and into the interior of said piece of shrink wrap film as said packs are moved on said conveyor; and said step of activating said nozzle openings comprises activating only those nozzle openings aimed at substantially the center of said at least two openings in said shrink wrap.

Still another feature or aspect of an embodiment is believed at the time of the filing of this patent application to possibly reside broadly in the method, wherein: said step of directing said gaseous medium comprises progressively activating and deactivating said nozzle openings, which are arranged in a stationary manner in multiple rows with multiple nozzle openings in each row, from row to row synchronously with the movement of a respective pack to continuously direct all of said gaseous medium through said at least two openings and into the interior of said shrink wrap film; said step of activating and deactivating said nozzle openings comprises one of: moving a slide valve associated with at least one of said nozzle openings to open or close at least one of said openings; and individually opening and closing said nozzles which comprise individually controllable nozzles; said step of activating and deactivating said nozzle openings comprises using an electronic controller or a computer to activate and deactivate said nozzle openings depending on the position of packs on said conveyor; said step of directing said gaseous medium at opposite sides of a pack of containers comprises directing said gaseous medium from two nozzle arrangements comprising a plurality of nozzle openings disposed on two opposing sides of said conveyor; and said conveyor comprises one of: a linear conveyor, a rotary carousel, and an elevator or lift system.

A further feature or aspect of an embodiment is believed at the time of the filing of this patent application to possibly reside broadly in the method, wherein: said step of directing said gaseous medium comprises moving a dome-shaped arrangement comprising two sets of nozzle openings disposed on two opposing sides of said conveyor in conjunction with a pack about which said dome-shaped arrangement is disposed; said step of directing said gaseous medium comprises activating said nozzle openings upon a pack being disposed in said dome-shaped arrangement, and deactivating said nozzle openings upon said dome-shaped arrangement being empty; said step of activating and deactivating said nozzle openings comprises one of: moving a slide valve associated with at least one of said nozzle openings to open or close at least one of said openings; and individually opening and closing said nozzles which comprise individually controllable nozzles; said step of activating and deactivating said nozzle openings comprises using an electronic controller or a computer to activate and deactivate said nozzle openings; and said conveyor comprises one of: a linear conveyor and a rotary carousel.

Another feature or aspect of an embodiment is believed at the time of the filing of this patent application to possibly reside broadly in a means for performing the method comprising: means for moving a first pack of containers into a shrink-wrapping arrangement; means for wrapping a first piece of shrink wrap film around said first pack of containers and substantially simultaneously forming at least two openings in said first piece of shrink wrap film to leave a portion of the surfaces of said first pack of containers open and uncovered by said first piece of shrink wrap film; and means for moving said first pack of containers wrapped in said first piece of shrink wrap film in said shrink-wrapping arrangement while substantially simultaneously heat shrinking said first piece of shrink wrap film around said first pack of containers by substantially solely continuously directing substantially all of a heated gaseous medium directed at said first pack of containers through said at least two openings and into the interior of said first piece of shrink wrap film.

Yet another feature or aspect of an embodiment is believed at the time of the filing of this patent application to possibly reside broadly in a shrink-wrapping arrangement for performing the method comprising: a moving arrangement being configured to move a first pack of containers into and through a shrink-wrapping arrangement; a wrapping arrangement being configured to wrap a first piece of shrink wrap film around said first pack of containers and substantially simultaneously form at least two openings in said first piece of shrink wrap film to leave a portion of the surfaces of said first pack of containers open and uncovered by said first piece of shrink wrap film; and a heat-shrinking arrangement being configured to heat shrink said first piece of shrink wrap film around said first pack of containers by substantially solely continuously directing substantially all of a heated gaseous medium directed at said first pack of containers through said at least two openings and into the interior of said first piece of shrink wrap film upon said first pack of containers being moved through said shrink-wrapping arrangement.

Still another feature or aspect of an embodiment is believed at the time of the filing of this patent application to possibly reside broadly in a shrink-wrapping arrangement for performing the method comprising: a moving arrangement being configured to move a first pack of containers and a second pack of containers into and through a shrink-wrapping arrangement; a wrapping arrangement being configured to wrap a first piece of shrink wrap film around said first pack of containers and substantially simultaneously form at least two openings in said first piece of shrink wrap film to leave a portion of the surfaces of said first pack of containers open and uncovered by said first piece of shrink wrap film, and being configured to wrap a second piece of shrink wrap film around said second pack of containers and substantially simultaneously form at least two openings in said second piece of shrink wrap film to leave a portion of the surfaces of said second pack of containers open and uncovered by said second piece of shrink wrap film; and a heat-shrinking arrangement being configured to heat shrink said first piece of shrink wrap film around said first pack of containers by substantially solely continuously directing substantially all of a heated gaseous medium directed at said first pack of containers through said at least two openings and into the interior of said first piece of shrink wrap film upon said first pack of containers being moved through said shrink-wrapping arrangement, and being configured to heat shrink said second piece of shrink wrap film around said second pack of containers by substantially solely continuously directing substantially all of a heated gaseous medium directed at said second pack of containers through said at least two openings and into the interior of said second piece of shrink wrap film upon said second pack of containers being moved through said shrink-wrapping arrangement; said moving arrangement comprising a conveyor; a directing arrangement being configured to direct said gaseous medium at opposite sides of a pack of containers and perpendicular to the direction of movement of said conveyor; said directing arrangement being configured to direct said gaseous medium to minimize interruption or disruption of the flow of gaseous medium by portions of said shrink wrap film disposed about or adjacent said at least two openings; said directing arrangement comprising a nozzle arrangement comprising a plurality of nozzle openings arranged sequentially in the direction of movement of said conveyor; and said nozzle arrangement being configured to activate only nozzle openings disposed adjacent said packs and aimed at substantially the center of said at least two openings in said shrink wrap to direct all of said gaseous medium directed at said packs through said at least two openings and into the interior of said piece of shrink wrap film as said packs are moved on said conveyor.

A further feature or aspect of an embodiment is believed at the time of the filing of this patent application to possibly reside broadly in a shrink-wrapping arrangement for performing the method comprising: a moving arrangement being configured to move a first pack of containers and a second pack of containers into and through a shrink-wrapping arrangement; a wrapping arrangement being configured to wrap a first piece of shrink wrap film around said first pack of containers and substantially simultaneously form at least two openings in said first piece of shrink wrap film to leave a portion of the surfaces of said first pack of containers open and uncovered by said first piece of shrink wrap film, and being configured to wrap a second piece of shrink wrap film around said second pack of containers and substantially simultaneously form at least two openings in said second piece of shrink wrap film to leave a portion of the surfaces of said second pack of containers open and uncovered by said second piece of shrink wrap film; and a heat-shrinking arrangement being configured to heat shrink said first piece of shrink wrap film around said first pack of containers by substantially solely continuously directing substantially all of a heated gaseous medium directed at said first pack of containers through said at least two openings and into the interior of said first piece of shrink wrap film upon said first pack of containers being moved through said shrink-wrapping arrangement, and being configured to heat shrink said second piece of shrink wrap film around said second pack of containers by substantially solely continuously directing substantially all of a heated gaseous medium directed at said second pack of containers through said at least two openings and into the interior of said second piece of shrink wrap film upon said second pack of containers being moved through said shrink-wrapping arrangement; said moving arrangement comprising a conveyor; a directing arrangement being configured to direct said gaseous medium at opposite sides of a pack of containers and perpendicular to the direction of movement of said conveyor; said directing arrangement being configured to direct said gaseous medium to minimize interruption or disruption of the flow of gaseous medium by portions of said shrink wrap film disposed about or adjacent said at least two openings; said directing arrangement comprising a nozzle arrangement comprising a plurality of nozzle openings arranged sequentially in the direction of movement of said conveyor; and said nozzle arrangement being configured to activate only nozzle openings disposed adjacent said packs and aimed at substantially the center of said at least two openings in said shrink wrap to direct all of said gaseous medium directed at said packs through said at least two openings and into the interior of said piece of shrink wrap film as said packs are moved on said conveyor; said nozzle openings being configured to be progressively activated and deactivated, which said nozzle openings are arranged in a stationary manner in multiple rows with multiple nozzle openings in each row, from row to row synchronously with the movement of a respective pack to continuously direct all of said gaseous medium through said at least two openings and into the interior of said shrink wrap film; said nozzle openings being configured to be activated and deactivated by one of: moving a slide valve associated with at least one of said nozzle openings to open or close at least one of said openings; and individually opening and closing said nozzles which comprise individually controllable nozzles; an electronic controller or a computer being configured to activate and deactivate said nozzle openings depending on the position of packs on said conveyor; said nozzle arrangement comprising two nozzle arrangements comprising a plurality of nozzle openings disposed on two opposing sides of said conveyor being configured to direct said gaseous medium at opposite sides of a pack of containers; and said conveyor comprises one of: a linear conveyor, a rotary carousel, and an elevator or lift system.

Another feature or aspect of an embodiment is believed at the time of the filing of this patent application to possibly reside broadly in a shrink-wrapping arrangement for performing the method comprising: a moving arrangement being configured to move a first pack of containers and a second pack of containers into and through a shrink-wrapping arrangement; a wrapping arrangement being configured to wrap a first piece of shrink wrap film around said first pack of containers and substantially simultaneously form at least two openings in said first piece of shrink wrap film to leave a portion of the surfaces of said first pack of containers open and uncovered by said first piece of shrink wrap film, and being configured to wrap a second piece of shrink wrap film around said second pack of containers and substantially simultaneously form at least two openings in said second piece of shrink wrap film to leave a portion of the surfaces of said second pack of containers open and uncovered by said second piece of shrink wrap film; and a heat-shrinking arrangement being configured to heat shrink said first piece of shrink wrap film around said first pack of containers by substantially solely continuously directing substantially all of a heated gaseous medium directed at said first pack of containers through said at least two openings and into the interior of said first piece of shrink wrap film upon said first pack of containers being moved through said shrink-wrapping arrangement, and being configured to heat shrink said second piece of shrink wrap film around said second pack of containers by substantially solely continuously directing substantially all of a heated gaseous medium directed at said second pack of containers through said at least two openings and into the interior of said second piece of shrink wrap film upon said second pack of containers being moved through said shrink-wrapping arrangement; said moving arrangement comprising a conveyor; a directing arrangement being configured to direct said gaseous medium at opposite sides of a pack of containers and perpendicular to the direction of movement of said conveyor; said directing arrangement being configured to direct said gaseous medium to minimize interruption or disruption of the flow of gaseous medium by portions of said shrink wrap film disposed about or adjacent said at least two openings; said directing arrangement comprising a nozzle arrangement comprising a plurality of nozzle openings arranged sequentially in the direction of movement of said conveyor; said nozzle arrangement being configured to activate only nozzle openings disposed adjacent said packs and aimed at substantially the center of said at least two openings in said shrink wrap to direct all of said gaseous medium directed at said packs through said at least two openings and into the interior of said piece of shrink wrap film as said packs are moved on said conveyor; said nozzle arrangement comprising a dome-shaped arrangement comprising two sets of nozzle openings disposed on two opposing sides of said conveyor being configured to direct said gaseous medium and to move in conjunction with a pack about which said dome-shaped arrangement is disposed; said nozzle openings being configured to be activated upon a pack being disposed in said dome-shaped arrangement, and deactivated upon said dome-shaped arrangement being empty; said nozzle openings being configured to be activated and deactivated by one of: moving a slide valve associated with at least one of said nozzle openings to open or close at least one of said openings; and individually opening and closing said nozzles which comprise individually controllable nozzles; an electronic controller or a computer being configured to activate and deactivate said nozzle openings; and said conveyor comprises one of: a linear conveyor and a rotary carousel.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of shrink wrapped articles or packages, and/or methods and/or apparatus for the production thereof, that may possibly be utilized or adapted for use in at least one possible embodiment may possibly be found in the following U.S. Patents: U.S. Pat. No. 7,478,514 entitled "Shipping container packing method using shrink wrap;" U.S. Pat. No. 7,363,728 entitled "Shrink wrap tunnel with variable set points;" U.S. Pat. No. 7,143,569 entitled "Calibrated shrink wrap packaging system and associated method;" U.S. Pat. No. 6,854,242 entitled "Modular shrink-wrap machine;" U.S. Pat. No. 6,817,163 entitled "Film delivery unit for shrink wrap packaging system and associated method;" U.S. Pat. No. 6,772,575 entitled "Shrink wrap apparatus and method of shrink wrapping products;" U.S. Pat. No. 6,622,767 entitled "Multi-stage shrink-wrap sealing and cutting apparatus;" U.S. Pat. No. 6,296,129 entitled "Method for shrink-wrapping containers and articles obtained thereby;" U.S. Pat. No. 5,771,662 entitled "Apparatus and methods for producing shrink wrap packaging;" U.S. Pat. No. 5,371,999 entitled "Shrink film wrapping machine;" U.S. Pat. No. 5,337,542 entitled "Shrink-wrapping method and apparatus;" U.S. Pat. No. 5,237,800 entitled "Shrink-wrapping method and apparatus;" U.S. Pat. No. 5,042,235 entitled "System for shrink-wrapping palletized goods;" U.S. Pat. No. 5,018,339 entitled "Apparatus for shrink-wrapping palletized goods;" U.S. Pat. No. 5,009,057 entitled "Method and apparatus for shrink wrapping;" U.S. Pat. No. 4,956,963 entitled "Method of sealing a shrink wrap package;" U.S. Pat. No. 4,947,605 entitled "Shrink-wrapping apparatus and method;" U.S. Pat. No. 4,940,141 entitled "Shrinkwrap beverage pack;" U.S. Pat. No. 4,873,814 entitled "Method of making a shrink wrap package;" and U.S. Pat. No. 4,815,603 entitled "Shrink wrap package with venting openings."

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Nov. 7, 2007, and/or cited elsewhere are hereby incorporated by reference as if set forth in their entirety herein as follows: U.S. Pat. No. 5,787,682, having the title "METHOD AND APPARATUS FOR SHRINKING END SEAMS IN A FILM WRAPPED AROUND A PRODUCT," published on Aug. 4, 1998; EP 1,683,723, having the title "APPARATUS FOR THE SELECTIVE SHRINKING OF A FILM WHEREIN A PRODUCT IS PACKAGED," published on Jul. 26, 2006; DE 10 2005 059295, having the following English translation of the German title "METHOD FOR SHRINK WRAP PACKAGING WITH PACKS MOVED OVER A HOT AIR GRID TO FUSE FOLDED OVER TAGS INTO A BASE TRAY FOLLOWED BY DIRECTED LATERAL HOT AIR JETS FOR THE SHRINK PROCESS," published on Feb. 14, 2006; and U.S. Pat. No. 4,228,345, having the title "Traveling infrared bell oven system," published on Oct. 14, 1980.

The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 036 590.9, filed on Aug. 4, 2006, having inventor Christian SCHILLING, and DE-OS 10 2006 036 590.9 and DE-PS 10 2006 036 590.9, and International Application No. PCT/EP2007/006750, filed on Jul. 31, 2007, having WIPO Publication No. WO 2008/014968 and inventor Christian SCHILLING, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/006750 and German Patent Application 10 2006 036 590.9 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/006750 and DE 10 2006 036 590.9 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

At Least Partial Nomenclature

1 Trading unit
2 Packaging unit
2.1 Volumes
3 Carrier
4 Shrink wrap film
4.1 Film overhang
5 Heat-shrink port
6, 6*a*, 6*b*, 6*c* Apparatus
7 Conveyor belt
8, 9 Nozzle arrangement
10 Distribution chamber
11 Nozzle opening
12, 13 Slider valve
14 Carousel system
15 Heat-shrink bell
16 Tube
17 Central hot air source
18 Frame
19 Nozzle opening
20, 21 Conveyor
22 Carousel system
23, 24 Nozzle arrangement
Elevator or lift system
Transport track
26.1, 26.2 Segment of transport track 27
27 Trading unit carrier
28, 29 Nozzle arrangement
A, B Hot air jet
C Direction of transport of the conveyor or conveyor belt 7
D Direction of movement of the carousel system 14 or 22
E, F Movement of the trading units 1 on the transport track 27

What is claimed is:

1. A method of shrinking a heat shrinkable film onto product units, said method comprising the steps of:

wrapping a product unit in heat shrinkable film and forming at least one opening;

directing at least one jet of a hot, gaseous medium at said at least one opening;

maintaining directing of said at least one jet of a hot, gaseous medium at said at least one opening while moving said product unit on a conveying arrangement;

shrinking said heat shrinkable film on said product unit;

said hot, gaseous medium is emitted from nozzle openings in a nozzle arrangement disposed to extend along the direction of transport; and said directed flow of hot, gaseous medium at said openings is maintained during movement of said product unit by activating each nozzle opening only upon said moving product unit being in a position to receive, via essentially solely said openings, a directed flow of hot, gaseous medium from said nozzle.

2. The method according to claim 1, wherein said product unit comprises a group of articles.

3. The method according to claim 2, wherein said hot, gaseous medium is directed at said product unit in a direction transverse or perpendicular to the direction of movement of said conveyor.

4. The method according to claim 3, wherein said hot, gaseous medium is directed at at least one side of said product unit.

5. The method according to claim 4, wherein:

said method further comprises wrapping said product unit in said heat shrinkable film so as to form with said heat shrinkable film two openings on opposite sides of said product unit;

said hot, gaseous medium is directed at said opposite sides of said product unit via said openings.

6. The method according to claim 5, wherein said hot, gaseous medium is directed essentially solely at a central portion of said openings so as not to contact overhanging, edge, and/or corner portions of said heat-shrinkable film.

7. The method according to claim 6, wherein said nozzle openings are disposed in rows, with a plurality of nozzle openings in each row, and at least one or a plurality of nozzle openings are progressively activated and deactivated from row to row synchronously with the movement of said product unit to maintain said directed flow of hot, gaseous medium at said openings, which hot, gaseous medium comprises hot air.

8. The method according to claim 7, wherein:

said nozzle openings are actuated via shutters or slide valves, or said nozzle openings are individually-controllable; and the activation and deactivation of said nozzle openings is performed by an electronic controller or a computer as a function of the position of said product unit.

9. The method according to claim 8, wherein:

said nozzle openings are disposed on two opposing sides of said conveyor; and said conveyor is either an essentially linear transport track or a circular transport track formed by a carousel system.

10. The method according to claim 8, wherein:

said nozzle openings are disposed on two opposing sides of said conveyor; and said conveyor is an elevator system.

11. A method of shrinking a heat shrinkable film onto product units, said method comprising the steps of:

wrapping a product unit in heat shrinkable film, which wrapping of heat shrinkable film forms an opening therein on a side of said product unit;

emitting hot, gaseous medium solely from at least one discharge, which said at least one discharge is disposed to emit said hot, gaseous medium solely at said side of said product unit having said opening in said heat shrinkable film, and thereby shrinking said heat shrinkable film on said product unit while simultaneously moving said product unit on a conveying arrangement along a transport path; and controlling the emission of said hot, gaseous medium such that essentially all of said hot, gaseous medium emitted from said at least one discharge to shrink said heat shrinkable film on said product unit, during movement of said product unit along said transport path, is directed at said side of said product unit having said opening in said heat shrinkable film.

12. The method according to claim 11, wherein said step of controlling the emission of said hot, gaseous medium comprises directing essentially all of said hot, gaseous medium at a central portion of said opening so as not to contact portions of said heat-shrinkable film prior to passage of said hot, gaseous medium into and through said opening, during movement of said product unit along said transport path, such that said heat-shrinkable film is shrunk from the inside out.

13. The method according to claim 11, wherein said step of controlling the emission of said hot, gaseous medium comprises:

maintaining said at least one discharge in a deactivated state;

activating said at least one discharge only upon said product unit being in a position in which position essentially all of said hot, gaseous medium emitted from said at least one discharge is directed at said side of said product unit having said opening in said heat shrinkable film; and moving said at least one, activated, discharge in conjunction with said product unit during movement of said product unit along said transport path.

14. The method according to claim 13, wherein said at least one discharge is disposed in a movable heat-shrink dome, and method further comprises:

positioning said product unit in said heat-shrink dome; and moving said heat-shrink dome in conjunction with said product unit during movement of said product unit along said transport path.

15. The method according to claim 14, wherein said conveying arrangement is a circular transport track formed by a carousel system.

16. A method of shrinking a heat shrinkable film onto product units, said method comprising the steps of:

wrapping a product unit in heat shrinkable film, which wrapping of heat shrinkable film forms an opening therein on a side of said product unit;

emitting hot, gaseous medium from a plurality of discharges and thereby shrinking said heat shrinkable film on said product unit while simultaneously moving said product unit on a conveying arrangement along a transport path;

controlling the emission of said hot, gaseous medium such that essentially all of said hot, gaseous medium emitted from said plurality of discharges to shrink said heat shrinkable film on said product unit, during movement of said product unit along said transport path, is directed at said side of said product unit having said opening in said heat shrinkable film; and said step of controlling the emission of said hot, gaseous medium comprises:

maintaining said discharges in a deactivated state; and activating at least one of said discharges only upon said product unit being in a position during movement along said transport path, in which position essentially all of said hot, gaseous medium emitted from said at least one of said discharges is directed at said side of said product unit having said opening in said heat shrinkable film.

17. The method according to claim 16, wherein:

said plurality of discharges are disposed in first and second groups disposed on two opposing sides of said conveyor;

said first group of discharges is configured and disposed to emit hot, gaseous medium solely at said side of said product unit having said opening in said heat shrinkable film; and said second group of discharges is configured and disposed to emit hot, gaseous medium solely at an additional side of said product unit having an additional opening in said heat shrinkable film.

18. The method according to claim 17, wherein said conveying arrangement is a linear transport track.

19. The method according to claim 17, wherein said conveying arrangement is a circular transport track formed by a carousel system.

20. The method according to claim 17, wherein said conveying arrangement is an elevator system.

* * * * *